US010215032B2

(12) United States Patent
Chouhan

(10) Patent No.: US 10,215,032 B2
(45) Date of Patent: Feb. 26, 2019

(54) BLADE HAVING A HOLLOW PART SPAN SHROUD

(71) Applicant: General Electric Company, Schenectady, NY (US)

(72) Inventor: Rohit Chouhan, Bangalore (IN)

(73) Assignee: General Electric Company, Schenectady, NY (US)

( * ) Notice: Subject to any disclaimer, the term of this patent is extended or adjusted under 35 U.S.C. 154(b) by 353 days.

(21) Appl. No.: 15/088,204

(22) Filed: Apr. 1, 2016

(65) Prior Publication Data

US 2016/0215629 A1 Jul. 28, 2016

Related U.S. Application Data

(63) Continuation-in-part of application No. 13/662,891, filed on Oct. 29, 2012, now Pat. No. 9,328,619.

(51) Int. Cl.

| | |
|---|---|
| ***F01D 5/18*** | (2006.01) |
| ***F01D 5/22*** | (2006.01) |
| ***F04D 29/32*** | (2006.01) |
| ***F01D 5/28*** | (2006.01) |

(52) U.S. Cl.

CPC ..... *F01D 5/187* (2013.01); *F01D 5/22* (2013.01); *F01D 5/225* (2013.01); *F01D 5/28* (2013.01); *F04D 29/324* (2013.01); *F05D 2220/31* (2013.01); *F05D 2230/237* (2013.01); *F05D 2250/185* (2013.01); *F05D 2260/20* (2013.01); *F05D 2260/96* (2013.01); *F05D 2300/175* (2013.01)

(58) Field of Classification Search

CPC . F01D 5/22; F01D 5/225; F01D 5/187; F01D 5/28; F04D 29/324; F05D 2220/31; F05D 2230/237; F05D 2250/185; F05D 2260/20; F05D 2260/96; F05D 2300/175

USPC ..... 416/190, 191, 500

See application file for complete search history.

(56) References Cited

U.S. PATENT DOCUMENTS

| | | | | | |
|---|---|---|---|---|---|
| 3,990,813 | A * | 11/1976 | Imai | F01D 5/22 | 416/196 R |
| 4,257,743 | A * | 3/1981 | Fujii | F01D 5/22 | 416/196 R |
| 4,260,331 | A | 4/1981 | Goodwin | | |
| 4,798,519 | A | 1/1989 | Zipps et al. | | |
| 5,067,876 | A | 11/1991 | Moreman, III | | |
| 5,174,720 | A | 12/1992 | Gradl | | |

(Continued)

OTHER PUBLICATIONS

U.S. Appl. No. 15/093,959, Office Action dated Apr. 12, 2018, 20 pages.

(Continued)

*Primary Examiner* — Aaron R Eastman

(74) *Attorney, Agent, or Firm* — Ernest G. Cusick; Hoffman Warnick LLC

(57) ABSTRACT

A rotating blade for use in a turbomachine is disclosed. In an embodiment, the rotating blade includes an airfoil portion, a root section affixed to a first end of the airfoil portion, and a tip section affixed to a second end of the airfoil portion, the second end being opposite the first end. A part span shroud is affixed to the airfoil portion between the tip section and the root section, wherein the part span shroud further comprises a hollow portion, wherein the hollow portion is devoid of any coupling structure therein.

18 Claims, 14 Drawing Sheets

(56) References Cited

U.S. PATENT DOCUMENTS

| | | | | |
|---|---|---|---|---|
| 5,267,834 | A | 12/1993 | Dinh et al. | |
| 5,277,549 | A | 1/1994 | Chen et al. | |
| 5,299,915 | A | 4/1994 | Dinh et al. | |
| 5,393,200 | A | 2/1995 | Dinh et al. | |
| 5,480,285 | A | 1/1996 | Patel et al. | |
| 5,494,408 | A | 2/1996 | Seeley et al. | |
| 5,531,569 | A | 7/1996 | Seeley | |
| 5,695,323 | A * | 12/1997 | Pfeifer | F01D 5/22 416/190 |
| 5,829,955 | A | 11/1998 | Saito et al. | |
| 6,142,737 | A | 11/2000 | Seeley et al. | |
| 6,435,833 | B1 | 8/2002 | Reluzco et al. | |
| 6,435,834 | B1 | 8/2002 | Reluzco et al. | |
| 6,499,959 | B1 | 12/2002 | Reluzco et al. | |
| 6,568,908 | B2 | 5/2003 | Namura et al. | |
| 6,575,700 | B2 | 6/2003 | Arai et al. | |
| 6,652,237 | B2 | 11/2003 | Yehle et al. | |
| 6,682,306 | B2 | 1/2004 | Murakami et al. | |
| 6,814,543 | B2 | 11/2004 | Barb et al. | |
| 6,846,160 | B2 | 1/2005 | Saito et al. | |
| 6,893,216 | B2 | 5/2005 | Snook et al. | |
| 7,097,428 | B2 | 8/2006 | Barb et al. | |
| 7,195,455 | B2 | 3/2007 | Stonitsch et al. | |
| 7,946,822 | B2 | 5/2011 | Slepski et al. | |
| 8,047,796 | B2 | 11/2011 | Riaz et al. | |
| 8,075,272 | B2 | 12/2011 | Riaz et al. | |
| 8,096,775 | B2 | 1/2012 | Riaz et al. | |
| 8,100,657 | B2 | 1/2012 | Riaz et al. | |
| 8,523,525 | B2 | 9/2013 | Marra | |
| 8,684,692 | B2 | 4/2014 | Mayer et al. | |
| 8,894,353 | B2 * | 11/2014 | McCracken | F01D 5/22 415/119 |
| 2002/0057969 | A1 * | 5/2002 | Namura | F01D 5/16 416/238 |
| 2003/0049131 | A1 | 3/2003 | Murakami et al. | |
| 2004/0126235 | A1 | 7/2004 | Barb et al. | |
| 2007/0292265 | A1 | 12/2007 | Burdgick et al. | |
| 2008/0089788 | A1 * | 4/2008 | Loehle | F01D 5/22 416/191 |
| 2008/0166240 | A1 | 7/2008 | Scott et al. | |
| 2009/0202344 | A1 * | 8/2009 | Bruce | F01D 5/225 415/198.1 |
| 2009/0214345 | A1 | 8/2009 | DeMania et al. | |
| 2010/0021306 | A1 | 1/2010 | Mujezinovic et al. | |
| 2010/0092295 | A1 | 4/2010 | Riaz et al. | |
| 2011/0194939 | A1 | 8/2011 | Marra | |
| 2012/0027616 | A1 * | 2/2012 | Merrill | B22C 9/04 416/241 B |
| 2013/0058788 | A1 | 3/2013 | Brandi et al. | |
| 2013/0243606 | A1 | 9/2013 | Crites et al. | |

OTHER PUBLICATIONS

Amir Mjezinovic, "Bigger Blades Cut Costs", Modern Power Systems, Feb. 2003, 2 pages.

Michael Boss, "Steam Turbine Technology Heats Up", PEI Magazine, Apr. 2003, 3 pages.

Jones. Office Action Communication for U.S. Appl. No. 12/205,942. Dated Aug. 2, 2011. 6 pages.

Jones. Notice of Allowance and Fees Due for U.S. Appl. No. 12/205,942. Dated Oct. 18, 2011. 13 pages.

Lee. Office Action Communication for U.S. Appl. No. 12/205,940. Dated Aug. 11, 2011. 13 pages.

Lee. Notice of Allowance and Fees Due for U.S. Appl. No. 12/205,940. Dated Nov. 29, 2011. 8 pages.

Lee. Office Action Communication for U.S. Appl. No. 12/205,941. Dated Aug. 15, 2011. 17 pages.

Lee. Notice of Allowance and Fees Due for U.S. Appl. No. 12/205,941. Dated Nov. 28, 2011. 11 pages.

U.S. Appl. No. 15/093,959, Notice of Allowance and Fees due dated Sep. 10, 2018, 5 pages.

* cited by examiner

BLADE HAVING A HOLLOW PART SPAN SHROUD

CROSS-REFERENCE TO RELATED APPLICATIONS

This application is a continuation-in-part of currently pending U.S. patent application Ser. No. 13/662,891 filed on Oct. 29, 2012. The application identified above is incorporated herein by reference in its entirety for all that it contains in order to provide continuity of disclosure.

BACKGROUND OF THE INVENTION

The invention relates generally to a rotating blade for use in a turbomachine. More particularly, the invention relates to a rotating blade including a part span shroud having a hollow portion therein, the blade further including an optimized fillet size.

The fluid flow path of a turbomachine such as a steam or gas turbine is generally formed by a stationary casing and a rotor. In this configuration, a number of stationary vanes are attached to the casing in a circumferential array, extending inward into the flow path. Similarly, a number of rotating blades are attached to the rotor in a circumferential array and extend outward into the flow path. The stationary vanes and rotating blades are arranged in alternating rows so that a row of vanes and the immediate downstream row of blades form a stage. The vanes serve to direct the flow path so that it enters the downstream row of blades at the correct angle. Airfoils of the blades extract energy from the working fluid, thereby developing the power necessary to drive the rotor and the load attached thereto.

The blades of the turbomachine may be subject to vibration and axial torsion as they rotate at high speeds. To address these issues, blades typically include part span shrouds disposed on the airfoil portion at an intermediate distance between the tip and the root section of each blade. The part span shrouds are typically affixed to each of the pressure (concave) and suction (convex) sides side of each airfoil, such that the part span shrouds on adjacent blades matingly engage and frictionally slide along one another during rotation of the rotor. Part span shrouds having solid construction have greater weights and typically require larger fillets to ease structural stress between the part span shroud and the airfoil surface and to support the part span shroud on the airfoil. This tends to result in less aerodynamic blades, and therefore a decrease in flow rate and overall performance of the turbomachine.

BRIEF DESCRIPTION OF THE INVENTION

A first aspect of the disclosure provides a rotating blade for a turbomachine, the rotating blade comprising: an airfoil portion; a root section affixed to a first end of the airfoil portion; a tip section affixed to a second end of the airfoil portion, the second end being opposite the first end; and a part span shroud affixed to the airfoil portion between the root section and the tip section, wherein the part span shroud further comprises a hollow portion, wherein the hollow portion is devoid of any coupling structure therein.

A second aspect of the disclosure provides a turbomachine comprising: a rotor rotatably mounted within a stator, the rotor including a shaft; and at least one rotor wheel mounted on the shaft, each of the at least one rotor wheels including a plurality of radially outwardly extending blades mounted thereto. Each blade includes: an airfoil portion; a root section affixed to a first end of the airfoil portion; a tip section affixed to a second end of the airfoil portion, the second end being opposite the first end; a part span shroud affixed to the airfoil portion between the tip section and the root section, wherein the part span shroud further comprises a hollow portion, wherein the hollow portion is devoid of any coupling structure therein.

These and other aspects, advantages and salient features of the invention will become apparent from the following detailed description, which, when taken in conjunction with the annexed drawings, where like parts are designated by like reference characters throughout the drawings, disclose embodiments of the invention.

Figure 1:
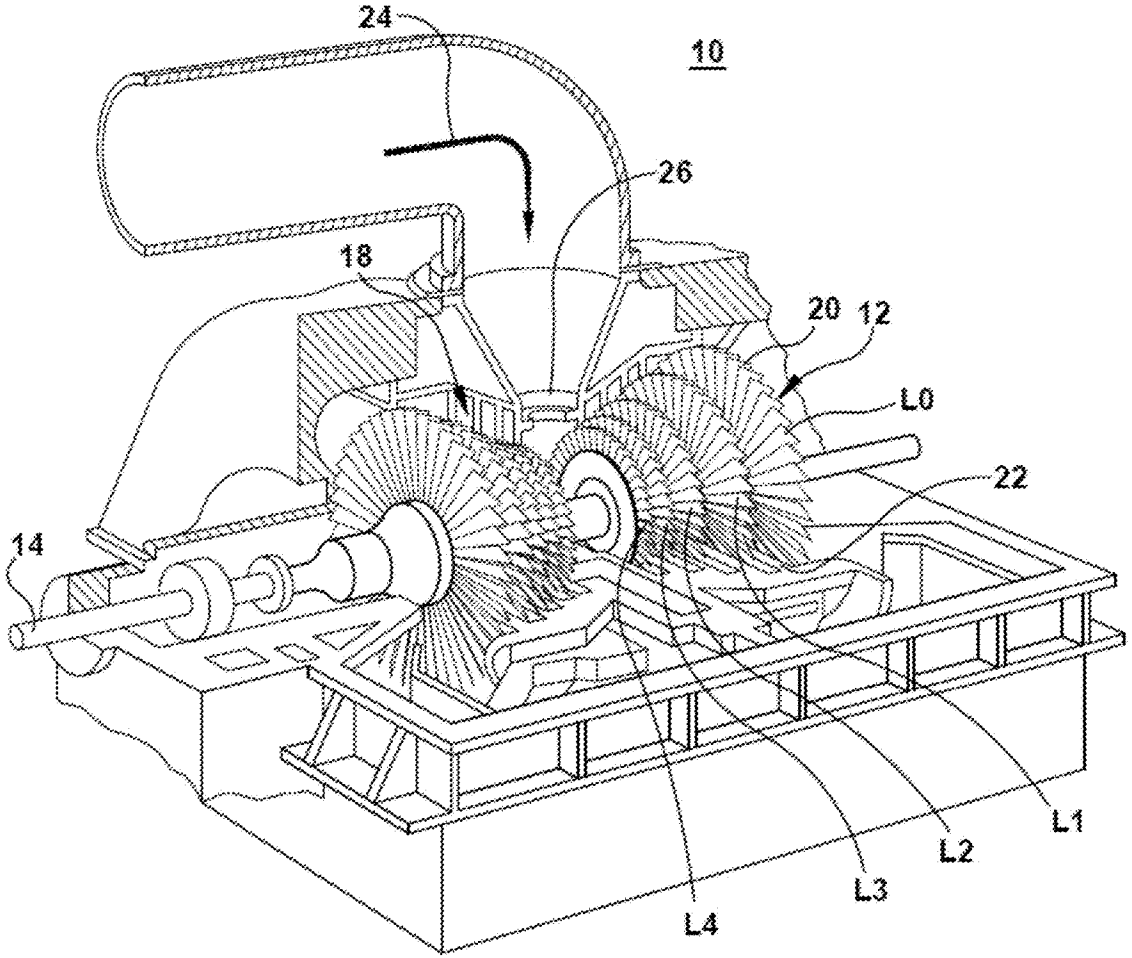
FIG. 1 shows a perspective partial cutaway illustration of a steam turbine according to an embodiment of the invention.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

At least one embodiment of the present invention is described below in reference to its application in connection with the operation of one of a gas or steam turbine engine. Although embodiments of the invention are illustrated relative to a gas and a steam turbine engine, it is understood that the teachings are equally applicable to other electric machines including, but not limited to, gas turbine engine compressors, and fans and turbines of aviation gas turbines. Further, at least one embodiment of the present invention is described below in reference to a nominal size and including a set of nominal dimensions. However, it should be apparent to those skilled in the art that the present invention is likewise applicable to any suitable turbine and/or compressor. Further, it should be apparent to those skilled in the art that the present invention is likewise applicable to various scales of the nominal size and/or nominal dimensions.

Figure 2:
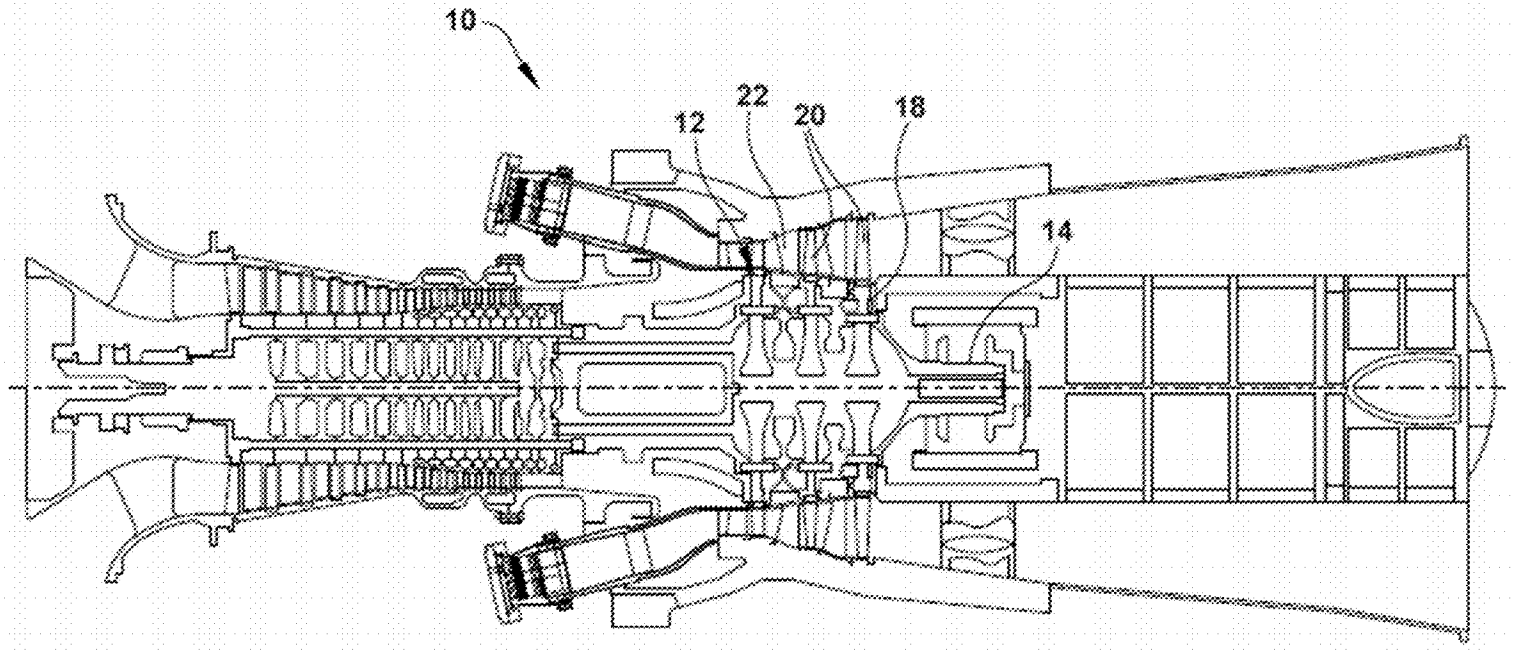
FIG. 2 shows a cross sectional illustration of a gas turbine according to an embodiment of the invention.

Referring to the drawings, FIGS. 1-2 illustrate exemplary turbine 10 environments. FIG. 1 shows a perspective partial cut-away illustration of a steam turbine 10. The steam turbine 10 includes a rotor 12 that includes a shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extends circumferentially around shaft 14 and are axially positioned between adjacent rows of blades 20. Stationary vanes 22 cooperate with blades 20 to form a turbine stage and to define a portion of a steam flow path through turbine 10.

In operation, steam 24 enters an inlet 26 of turbine 10 and is channeled through stationary vanes 22. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine. Accordingly, a large steam turbine unit may actually include several turbines that are all co-axially coupled to the same shaft 14. Such a unit may, for example, include a high pressure turbine coupled to an intermediate-pressure turbine, which is coupled to a low pressure turbine.

In one embodiment of the present invention, shown in FIG. 1, turbine 10 comprise five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, more or fewer than five stages may be present.

With reference to FIG. 2, a cross sectional illustration of a gas turbine 10 is shown. The turbine 10 includes a rotor 12 that includes a shaft 14 and a plurality of axially spaced rotor wheels 18. In some embodiments, each rotor wheel 18 may be made of metal such as, for example, steel. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14 and are axially positioned between adjacent rows of blades 20.

During operation, air at atmospheric pressure is compressed by a compressor and delivered to a combustion stage. In the combustion stage, the air leaving the compressor is heated by adding fuel to the air and burning the resulting air/fuel mixture. The gas flow resulting from combustion of fuel in the combustion stage then expands through turbine 10, delivering some of its energy to drive turbine 10 and produce mechanical power. To produce driving torque, turbine 10 consists of one or more stages. Each stage includes a row of vanes 22 and a row of rotating blades 20 mounted on a rotor wheel 18. Vanes 22 direct incoming gas from the combustion stage onto blades 20. This drives rotation of the rotor wheels 18, and as a result, shaft 14, producing mechanical power.

Figure 3:
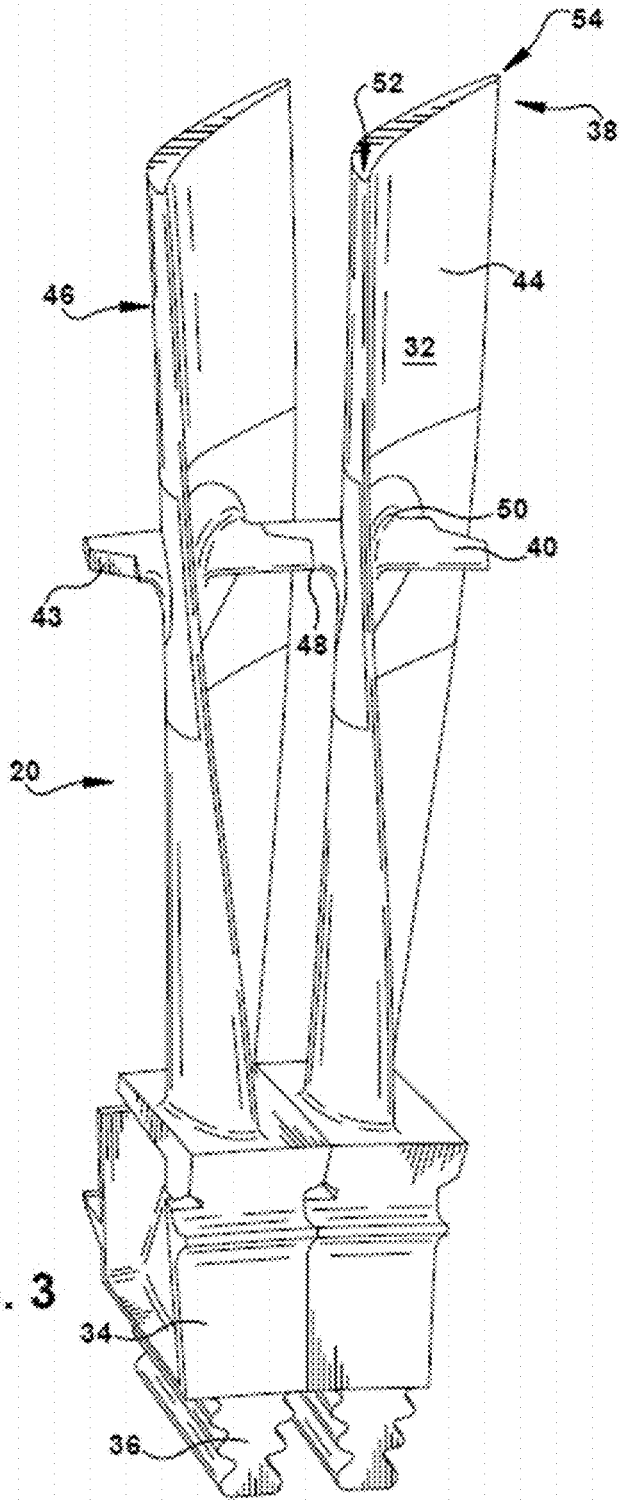
FIG. 3 shows a perspective illustration of two adjacent rotating blades according to an embodiment of the invention.

Turning to FIG. 3, blade 20 is shown in greater detail. Blade 20 includes an airfoil portion 32. A root section 34 is affixed to a first end of the airfoil portion 32. When assembled as in FIGS. 1-2, root section 34 is disposed at a radially inward end of airfoil portion 32. A blade attachment member 36 projects from the root section 34. In some embodiments, blade attachment member 36 may be a dovetail, but other blade attachment member shapes and configurations are well known in the art and are also contemplated. At a second, opposite end of airfoil portion 32 is a tip section 38. When assembled as shown in FIGS. 1-2, the second end of airfoil portion 32 at which tip section 38 is disposed is a radially outward end of blade 20.

Figure 5:
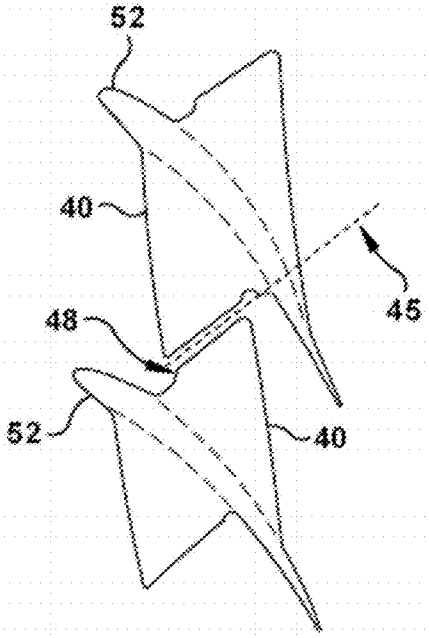
FIG. 5 shows a top view of a portion of two adjacent rotating blades including part span shrouds according to an embodiment of the invention.
Figure 4:
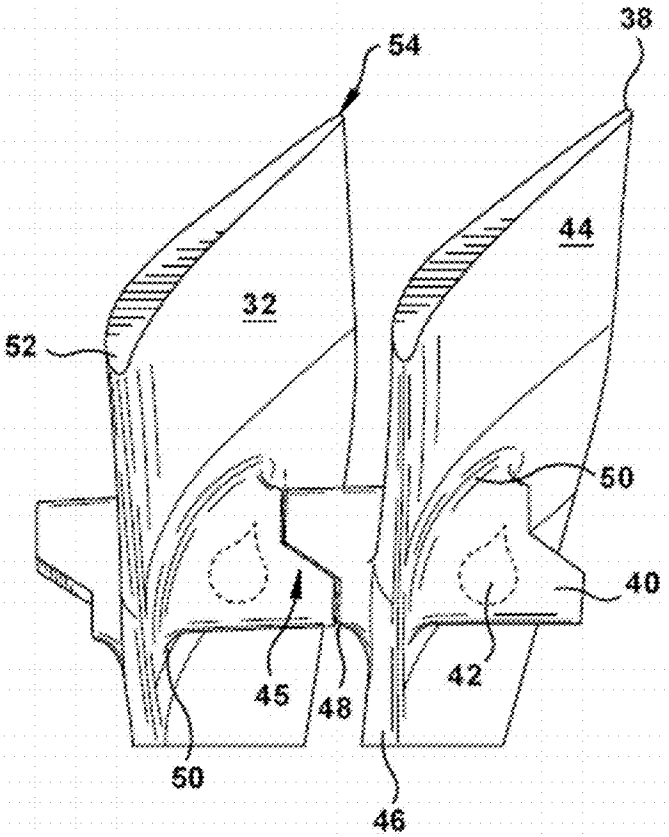
FIG. 4 shows an enlarged perspective illustration of a portion of two adjacent rotating blades including part span shrouds according to an embodiment of the invention.

As shown in FIGS. 3-4, a part span shroud 40 is affixed to an intermediate section of airfoil portion 32 between root section 34 and tip section 38. Part span shrouds 40 are located on both the pressure (concave) side 44 and the suction (convex) side 46 of blade 20. The interrelation of embodiments of adjacent part span shrouds 40 is shown in detail in FIGS. 4-5. During zero-speed conditions, a gap 48 exists between adjacent part span shrouds 40 which are affixed to airfoil portions 32 of neighboring blades 20 (FIG. 4). Gap 48 is closed as the turbine rotor wheel 18 (FIGS. 1-2) begins to rotate and approaches operating speed, and the blades untwist. As shown in FIG. 4, part span shrouds 40 may use a z-locking configuration, in which contact surfaces 43 (FIG. 3) of adjacent part span shrouds 40 contact one another along line 45 (FIG. 4) which may be substantially z-shaped. In other embodiments, as shown in FIG. 5, part span shrouds 40 may use a straight-angular configuration as is known in the art, in which part span shrouds contact one another along line 45. Therefore, in either embodiment, no coupling structure is needed to couple adjacent part span shrouds 40. Rather, adjacent part span shrouds 40 couple by merely contacting one another. Further, with reference to FIGS. 16-17, some embodiments may include a cover 60 for use at tip section 38 (FIG. 3). Cover 60 may improve the stiffness and dampening characteristics of blade 20. A seal tooth 62 may function as a sealing means to limit the flow of working fluid past the outer portion of blade 20. Seal tooth 62 can be a single rib or formed of multiple ribs, a plurality of straight or angled teeth, or one or more teeth of different dimensions (e.g., a labyrinth type seal).

Figure 16:
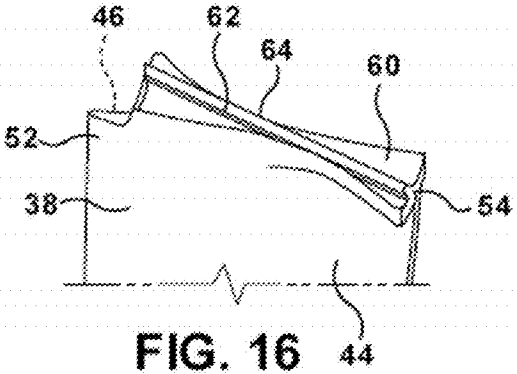

As shown in FIG. 16, cover 60 comprises a flat section that extends away from leading edge 52 at a predetermined distance therefrom to trailing edge 54. Cover 60 has a width that narrows substantially from the end located at the predetermined distance away from leading edge 52 to a location that is in a substantially central location 64 with respect to trailing edge 54 and leading edge 52. The width of cover 60 increases from central location 64 to trailing edge 54. The width of cover 60 at the end located at the predetermined distance away from leading edge 52 and the width of cover 60 at trailing edge 54 are substantially similar. FIG. 16 further shows that seal tooth 62 projects upward from cover 60, wherein seal tooth 62 extends from the end located at the predetermined distance away from leading edge 52 through substantially central location 64 to trailing edge 54. FIG. 16 also shows that cover 60 extends over suction side 46 at the end located at the predetermined distance away from leading edge 52 to about central location 64 and cover 60 extends over pressure side 44 from central location 64 to trailing edge 54.

Figure 17:
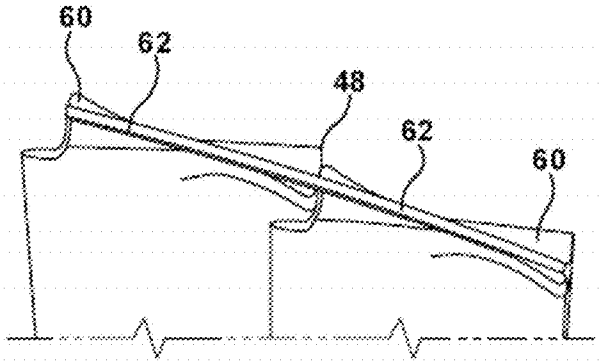
FIGS. 16-17 shows a perspective view of a cover, and the interrelation of two such covers, respectively, in accordance with an embodiment of the invention.

FIG. 17 is a perspective illustration showing the interrelation of adjacent covers 60 according to one embodiment of the present invention. In particular, FIG. 17 illustrates an initially assembled view of covers 60. Covers 60 are designed to have a gap 48 between adjacent covers 60 during initial assembly and/or at zero speed conditions, as described above. As can be seen, seal teeth 62 are also slightly misaligned in the zero rotation condition. As turbine rotor wheel 18 (shown in FIGS. 1-2) is rotated, blades 20 begin to untwist as described above. As the revolution per minutes (RPM) of blades 20 approach the operating level, the blades untwist due to centrifugal force, the gaps 48 close and the seal teeth 62 becomes aligned with each other so that there is nominal gap with adjacent covers and blades 20 form a single continuously coupled structure in a similar fashion to the embodiments described above.

Referring back to FIGS. 3-4, part span shrouds 40 may be aerodynamically shaped to reduce windage losses and improve overall efficiency. The blade stiffness and damping characteristics are also improved as part span shrouds 40 contact each other during blade 20 untwist. As the blades 20 untwist, part span shrouds 40 contact their respective neighboring part span shrouds 40. The plurality of blades 20 behave as a single, continuously coupled structure that exhibits improved stiffness and dampening characteristics when compared to a discrete and uncoupled design. Blades 20 also exhibit reduced vibratory stresses.

Figure 6:
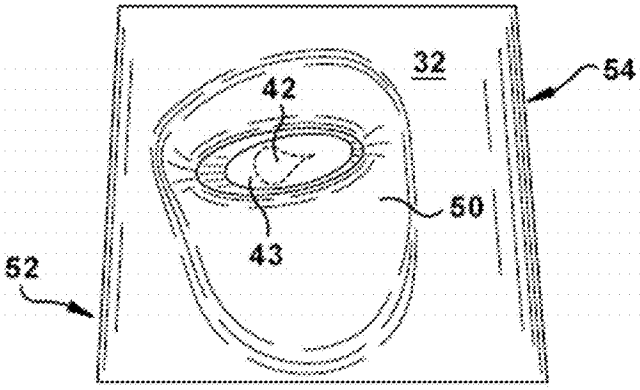
FIG. 6 shows a side view of a part span shroud according to an embodiment of the invention.

In various embodiments, part span shrouds 40 may take a variety of shapes. As shown in FIGS. 3-4, part span shrouds 40 may be substantially fin-shaped, and project outward from each of pressure side 44 and suction side 46 of airfoil portion 32. FIG. 6 depicts a winglet shaped part span shroud embodiment, although variations in the specific shape and dimensions are possible and are also considered part of the disclosure. Part span shroud 40 may be airfoil-shaped, as in FIG. 7, or elliptical-shaped, as in FIG. 8.

Figure 9:
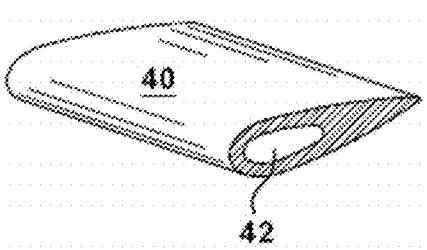
FIG. 9 shows a perspective partial cutaway illustration of a part span shroud according to an embodiment of the invention.
Figure 10:
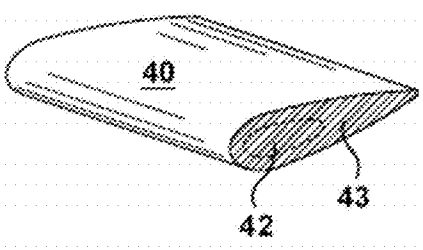
FIG. 10 shows a perspective view of a part span shroud according to an embodiment of the invention.
Figure 11:
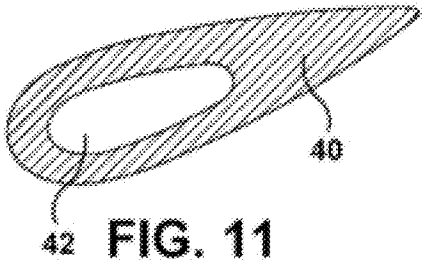
FIG. 11 shows a cross section of a part span shroud according to an embodiment of the invention.
Figure 12:
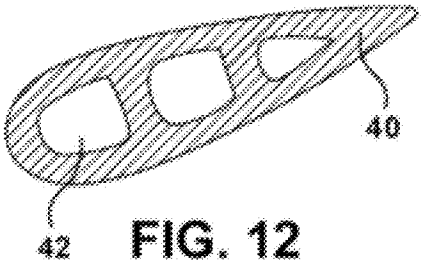
FIG. 12 shows a cross section of a part span shroud according to an embodiment of the invention.
Figure 13:
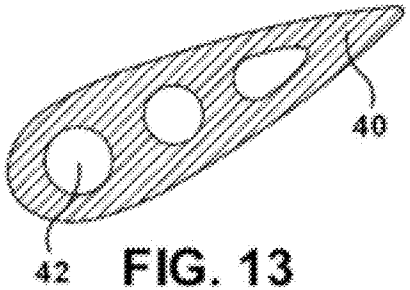
FIG. 13 shows a cross section of a part span shroud according to an embodiment of the invention.

As further shown in FIG. 9, part span shroud 40 may include a hollow portion 42, shown in phantom in FIGS. 4, 6, and 10. In various embodiments, hollow portion 42 may include any of a number of possible cavity shapes as shown in FIGS. 11-13. As shown, hollow portion 42 may consist of one cavity (FIG. 11) or more than one cavity (FIGS. 12-13), and which may be shaped substantially elliptically, or roundly, or which may follow a exterior curve of part span shroud 40. The configurations depicted in FIGS. 11-13 are not intended to be limiting, however; they are merely examples of possible configurations. Aspects of these configurations may be combined with one another. Other embodiments are also possible, and are considered part of the disclosure.

Figure 7:
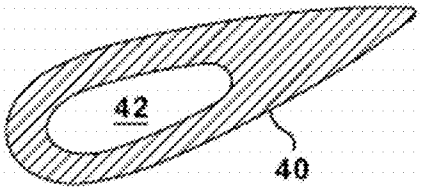
FIG. 7 shows a cross section of a part span shroud according to an embodiment of the invention.
Figure 8:
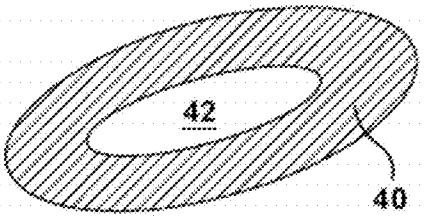
FIG. 8 shows a cross section of a part span shroud according to an embodiment of the invention.

As shown in FIGS. 7 and 9-11, in some embodiments, hollow portion 42 may be disposed on an interior of a leading edge portion of part span shroud 40, while in other embodiments, hollow portion 42 may be substantially centered in part span shroud 40 (FIG. 8). Part span shroud 40 may further include a contact surface 43 (FIG. 10) over hollow portion 42, which closes off or encloses hollow portion 42. The contact surface 43 may be on a face of part span shroud 40 that is opposite fillet 50. In some embodiments, contact surface 43 may comprise a brazed surface or a welded surface, and may be covered. It is understood that as described herein, brazing may be performed as an alternative to welding. As is understood in the art, welding and brazing may be used to join metals together. As is further understood in the art, welding may be performed by melting and fusing metals together, usually by adding a filler material. Brazing, by contrast, usually does not involve melting the base metals being joined, and is usually performed at lower temperatures than welding.

Figure 18:
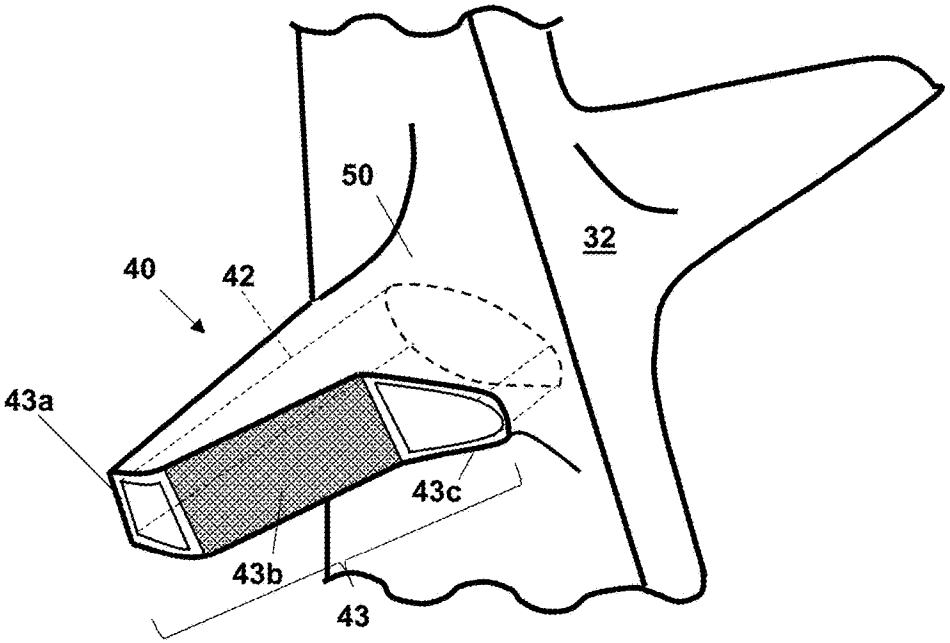
FIGS. 18-24 show enlarged perspective views of the part span shroud in accordance with embodiments of the invention.
Figure 19:
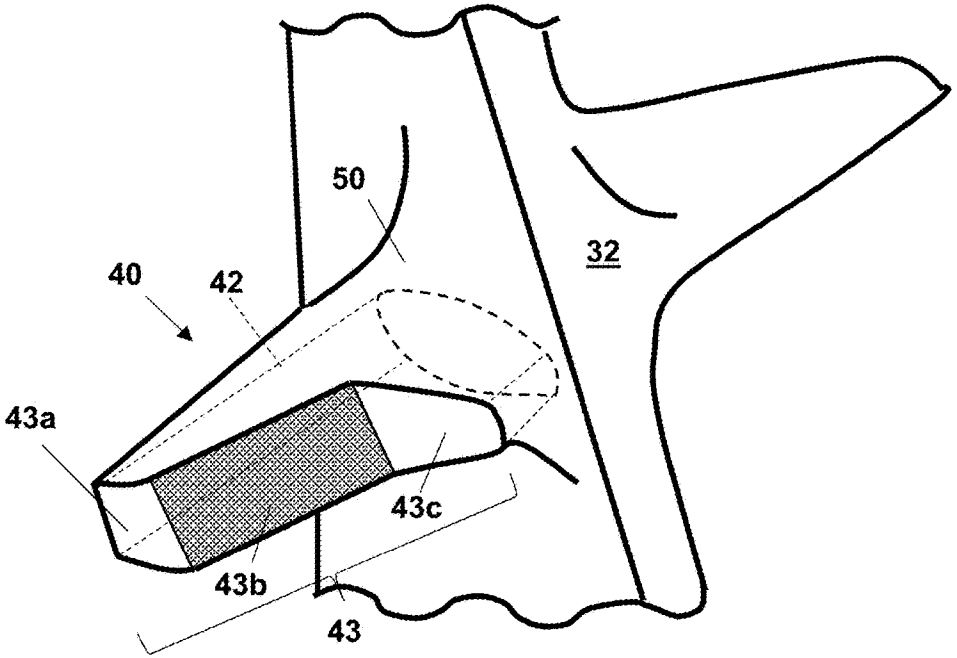

As shown in FIGS. 18-19, contact surface 43 may include a first surface section 43*a*, a second surface section 43*b*, and a third surface section 43*c*. Second surface section 43*b* may be disposed between first surface section 43*a* and third surface section 43*c* of contact surface 43. In one embodiment, as shown in FIG. 18, first surface section 43*a* and third surface section 43*c* may each be open or uncovered, such that hollow portion 42 is not enclosed or closed off at first surface section 43*a* and third surface section 43*c*. In another embodiment, as shown in FIG. 19, first surface section 43*a* and third surface section 43*c* may each be covered, e.g., by brazing or welding. In this embodiment, first surface section 43*a* and third surface section 43*c* may be covered with the same material that is used for airfoil portion 32, e.g., a nickel based alloy, a nickel based super alloy (having nickel, chromium and colbalt), or other material having similar properties. In either embodiment, second surface section 43*b* may include a more robust brazed or welded material, e.g., a hard metal sheet such as a colbalt-chromium-molybdenum alloy (e.g., Tribaloy® T800® from E.I. DU PONT DE NEMOURS AND COMPANY CORPORATION) or other material that provides strength and stability at high temperatures, or a hastealloy, e.g., cobalt-chromium-tungsten alloy (e.g., Coast Metal 64) or other material that provides high strength and stability at high temperature (e.g., up to 1100° C. or higher). Second surface section 43*b* of contact surface 43 receives a majority of the contact from another contact surface on a part span shroud of an adjacent airfoil (not shown in FIGS. 18-19). Therefore, covering second surface section 43*b* with more robust materials allows second surface section 43*b* to withstand more rubbing or contact from contact surface on the adjacent part span shroud.

As discussed herein, hollow portion 42 may include any number of cavities without departing from aspects of the disclosure. As shown in FIGS. 18-19, hollow portion 42 may include a single cavity that corresponds to, or is aligned with, each of first surface section 43*a*, second surface section 43*b*, and third surface section 43*c*. In another embodiment (not shown), hollow portion 42 may include more than one cavity wherein each cavity may correspond to, or be aligned with, one of first surface section 43*a*, second surface section 43*b*, or third surface section 43*c*. That is, hollow portion 42 may include three cavities wherein each of the three cavities aligns with one of first surface section 43*a*, second surface section 43*b*, and third surface section 43*c*. For example, hollow portion 42 may include a first cavity that is aligned with first surface section 43*a*, a second cavity aligned with second surface section 43*b*, and a third cavity aligned with third surface section 43*c*. As discussed herein, first surface section 43*a* and third surface section 43*c* may be open (FIG. 18) or closed (FIG. 19). Therefore, the first and third cavities of hollow portion 42 may be opened or closed, while the second cavity of hollow portion 42 may be closed due to its alignment with closed second surface section 43*b* (FIGS. 18-19). However, in another embodiment (not shown), more than one cavity may correspond to, or be aligned with, one of first surface section 43*a*, second surface section 43*b*, or third surface section 43*c*.

Referring now to FIG. 7, by positioning hollow portion 42 on the leading edge 52 side of part span shroud 40, as shown in FIG. 7, part span shroud 40 can be positioned on airfoil portion 32 such that it is nearer to leading edge 52 than to trailing edge 54 without creating any center of gravity imbalance. In particular, part span shroud 40 may be located on airfoil portion 32 such that the center of gravity of part span shroud 40 is laterally aligned with the center of gravity of blade 20, and further, may maintain this alignment while having part span shroud 40 disposed on airfoil portion 32 nearer to a leading edge 52 than to trailing edge 54. This positioning results in increased efficiency and decreased performance penalty.

Figure 14:
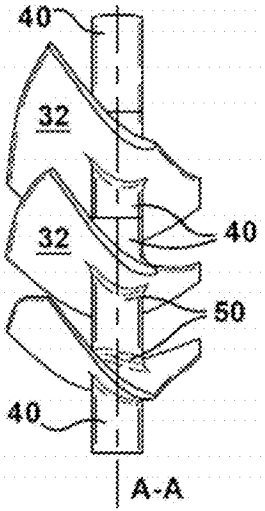
FIG. 14 shows a perspective view of the interrelation of part span shrouds affixed to adjacent blades according to an embodiment of the invention.
Figure 15:
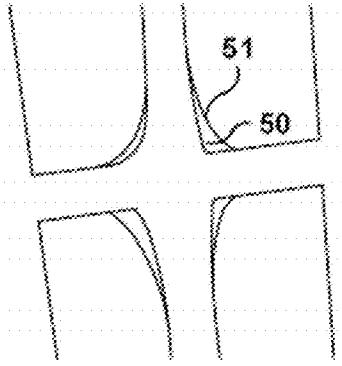
FIG. 15 shows a cross sectional schematic of a fillet along line A-A in FIG. 14, according to an embodiment of the invention.

Part span shroud 40 may further include fillet 50 (FIGS. 3-4, 6, 15-15) for easing an exterior corner formed by the part span shroud 40 and the airfoil portion 32 and supporting part span shroud 40 on airfoil portion 32. The size and shape of fillet 50 may be optimized based on the particular part span shroud 40 in a particular embodiment. In particular, part span shroud 40 may be optimized based on the shape, dimension, and weight of a particular part span shroud 40, including hollow portion 42. Specifically, as shown in FIGS. 14-15, embodiments in which part span shroud 40 includes hollow portion 42, may include a smaller fillet 50, i.e., it may ease the exterior corner between part span shroud 40 and airfoil portion 32 to a lesser degree, than a fillet 51 included on a part span shroud 40 that is solid and therefore weighs more and requires more support. Since it is an object of the present disclosure to have a part span shroud 40 that weighs less than a solid part span shroud, hollow portion 42 may be devoid of any coupling structure therein which would otherwise add to the weight of part span shroud 40. That is, hollow portion 42 may not include any bars, bolts, rods, e.g., tie rods, or other part span shroud attachment or coupling means for attaching adjacent part span shrouds therein. The smaller fillet 50 is more aerodynamic, and therefore leads to increased efficiency, relative to the larger fillet 51.

The blade 20 and part span shroud 40 described above may be used in a variety of turbomachine environments. For example, blade 20 having part span shroud 40 may operate in any of a front stage of a compressor, a latter stage in a gas turbine, a low pressure section blade in a steam turbine, a front stage of compressor, and a latter stage of turbine for aviation gas turbine.

Figure 20:
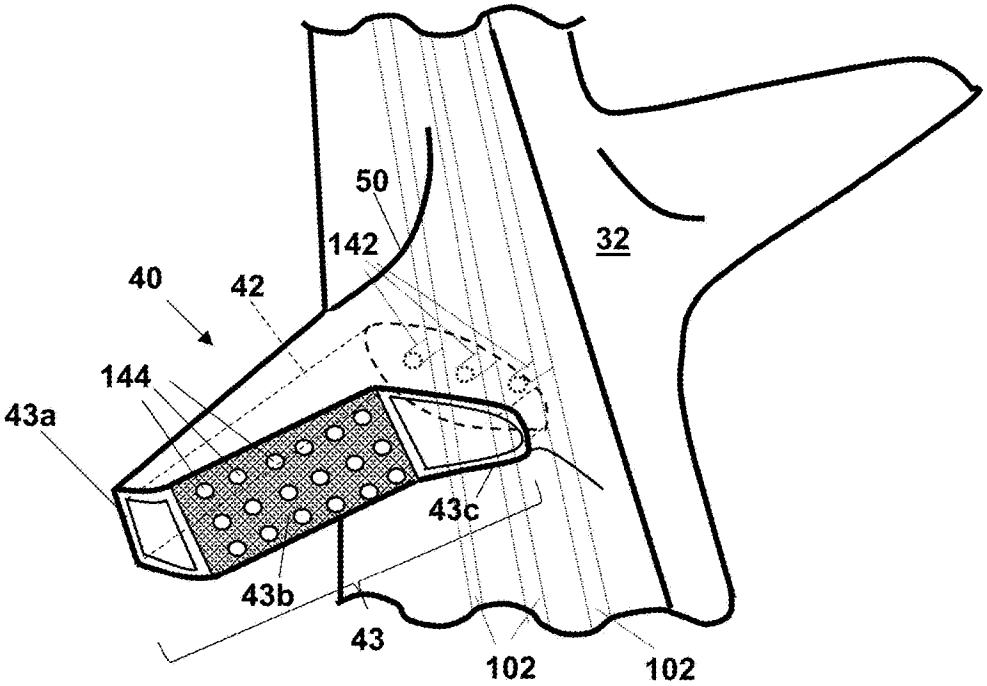
Figure 21:
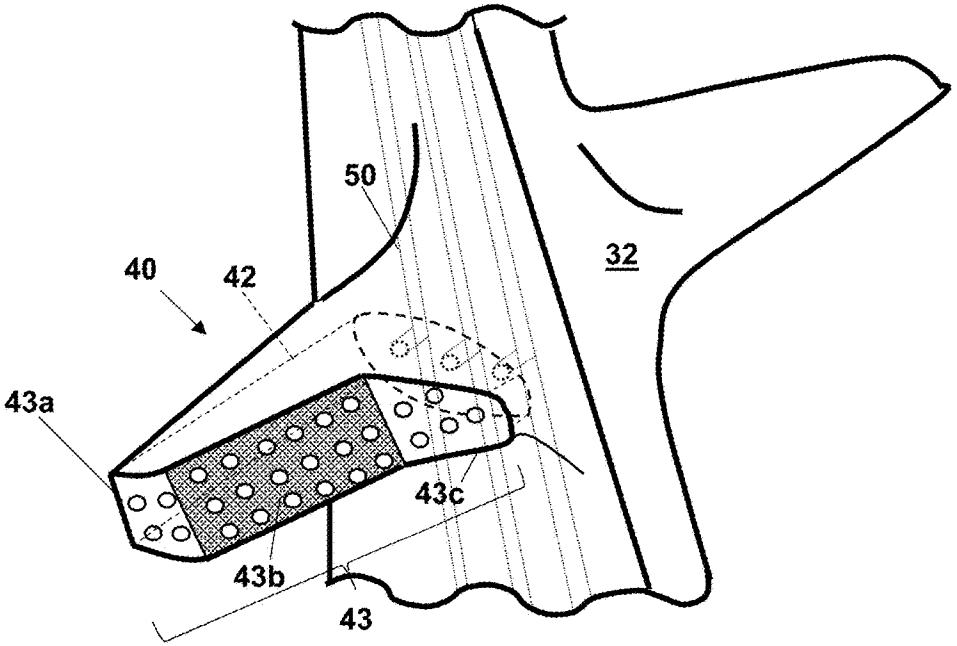

FIGS. 20-21 show another embodiment of the disclosure. In this embodiment, hollow portion 42 may be fluidly connected to radial cooling passages 102 within airfoil 32. As known in the art, airfoils, e.g., airfoil 32, may include a plurality of cooling passages, e.g., radial cooling passages 102, that extend longitudinally along the length of the airfoil. Radial cooling passages 102 may provide cooling fluid (not shown), e.g., air, longitudinally along the length of airfoil 32 to cool airfoil 32. According to another aspect of the disclosure, hollow portion 42 may be fluidly connected to radial cooling passages 102 via hollow passages 142. In some embodiments, each hollow passage 142 is fluidly connected to at least one radial cooling passage 102 within airfoil 32 through fillet 50. Such an embodiment provides a portion of the cooling fluid from radial cooling passages 102 to hollow portion 42 via hollow passages 142 and may cool part span shroud 40. Hollow passages 142 may be formed by drilling passages through fillet 50 to connect with radial cooling passages 102. However, in other embodiments, hollow passages 142 may be formed via casting or by additive manufacturing which will be discussed in more detail herein.

As discussed with respect to FIGS. 18-19, contact surface 43 may include first surface section 43*a*, second surface section 43*b*, and third surface section 43*c*. As shown in FIG. 20, in one embodiment, first surface section 43*a* and third surface section 43*c* may each be open or uncovered, such that hollow portion 42 is not enclosed or closed off at first surface section 43*a* and third surface section 43*c*. In another embodiment, as shown in FIG. 21, first surface section 43*a* and third surface section 43*c* may each be covered, e.g., by brazing or welding. In either embodiment, second surface section 43*b* may covered, e.g., by brazing or welding. However, in other embodiments, contact surface may be completely open such that none of first surface section 43*a*, second surface section 43*b*, or third surface section 43*c* are not brazed or welded.

Additionally, where a surface section, e.g., second surface section 43*b* (FIG. 20), or all of contact surface 43 (i.e., first surface section 43*a*, second surface section 43*b*, and third surface section 43*c* (FIG. 21)) of part span shroud 40 is covered, e.g., by brazing or welding, the cooling fluid from radial cooling passages 102 may cool contact surface 43 and part span shroud 40, and be released from part span shroud 40 through openings or holes 144 in contact surface 43. That is, openings 144 may be fluidly connected to hollow portion 42. Any number of openings 144 may be employed without departing from aspects of the disclosure. As contact surface 43 of part span shroud 40 contacts or rubs against another contact surface of an adjacent part span shroud, contact surface 43 may become heated. As such, this embodiment provides cooling of contact surface 43 and prevents contact surface 43 from overheating and becoming damaged. Therefore, part span shroud 40 may be lighter in weight and cooler than conventional part span shrouds. It is to be noted that FIGS. 20-21 only show three hollow passages 142 and three radial cooling passages 102 for brevity. It is to be understood that radial cooling passages 102 may include any number of radial cooling passages and hollow passages 142 may include any number of hollow passages without departing from aspects of the disclosure as described herein.

Figure 22:
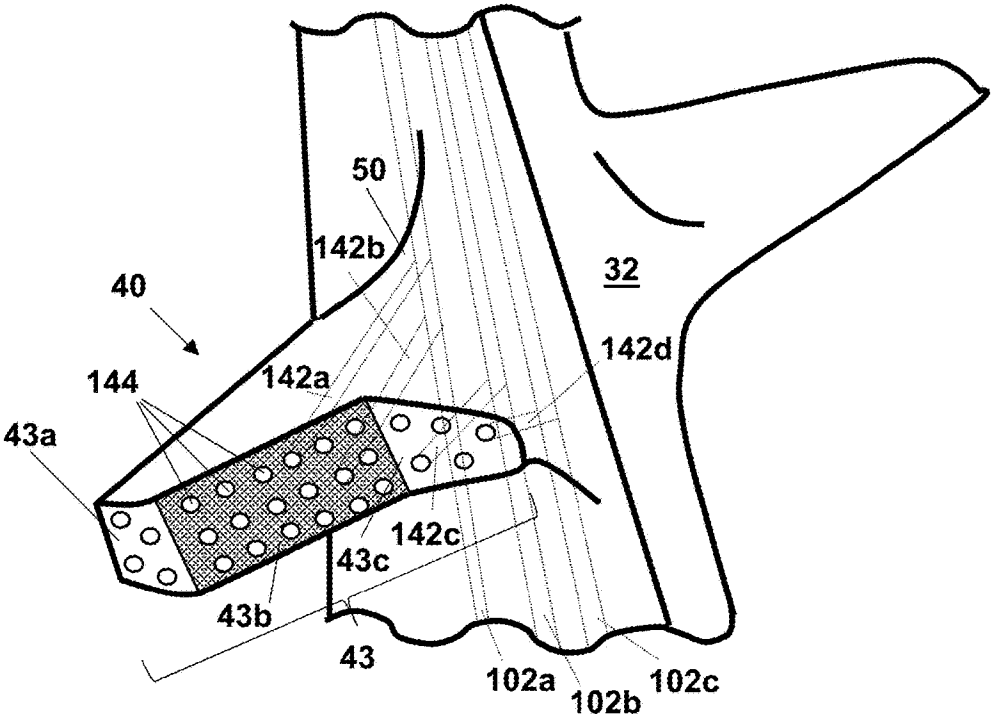

In another embodiment, part span shroud 40 may include a pluraity of hollow passages 142*a-d* which extend longitudinally within part span shroud 40 as shown in FIG. 22. Hollow passages 142*a-d* may fluidly connect radial cooling passages 102*a-c* to openings 144. That is, hollow passages 142*a-d* may extend from radial cooling passages 102*a-c* within airfoil 32 through fillet 50 and longitudinally within part span shroud 40 to openings 144 within contact surface 43. This embodiment may be an alternative to hollow passages 142 fluidly connected to a single hollow portion 42 as shown in FIGS. 20-21. It is to be noted that, in some embodiments, the number of openings 144 may correspond to, or be equal to, the number of hollow passages 142*a-d* which may in turn correspond to, or be equal to, the number of radial cooling passages 102. For example, each opening 144 may be fluidly connected to one hollow passage 142*a-d*, and the one hollow passage 142*a-d* may be fluidly connected to one radial cooling passage 102*a-c*. However, in another embodiment, more than one hollow passage 142*a-d* may be fluidly connected to a single opening 144 such that the single opening 144 allows release of the cooling fluid from more than one hollow passage 142*a-d*. In yet another embodiment, a single hollow passage 142*a-d* may be fluidly connected to more than one opening 144 such that more than one opening 144 allows release of the cooling fluid from the single hollow passage 142*a-d*. In yet another embodiment, more than one radial cooling passage 102*a-c* may be fluidly connected to a single hollow passage 142*a-d* or vice versa. For example, as shown in FIG. 22, radial cooling passage 102 is fluidly connected to both hollow passage 142*a* and 142*b*, while radial cooling passage 102*b* is fluidly connected to hollow passage 142*c* and radial cooling passage 102*c* is fluidly connected to hollow passage 142*d*. As should be clear, any configuration of radial cooling passages 102, hollow passages 142, and opening 144 may be used without departing from aspects of the disclosure as described herein.

Figure 23:
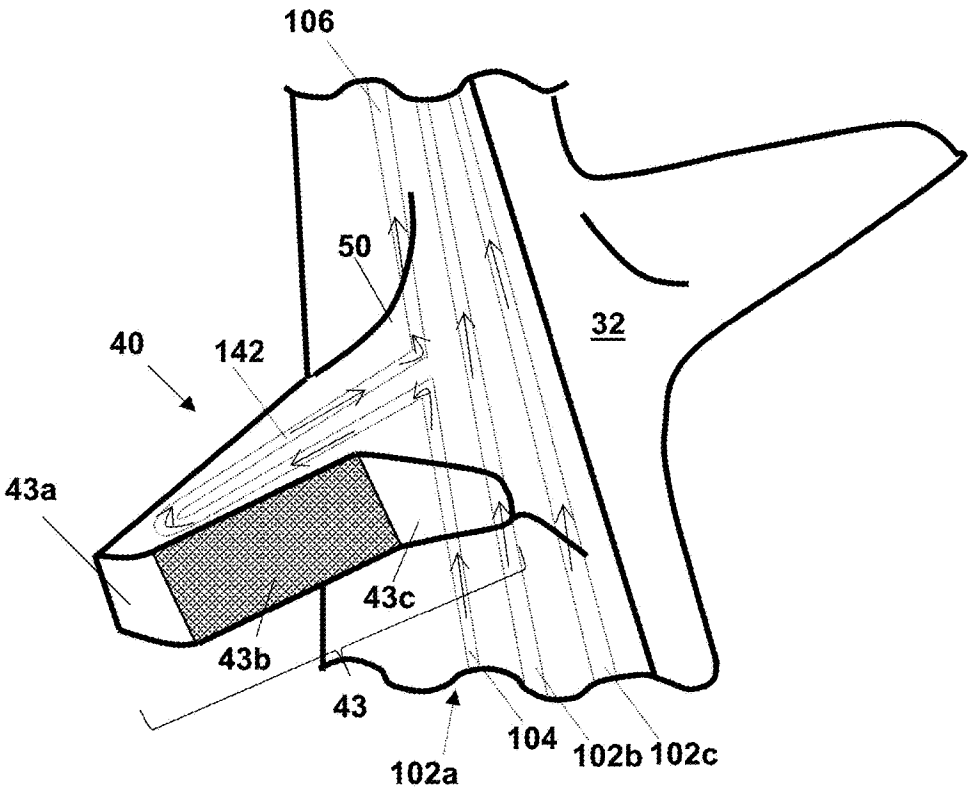
Figure 24:
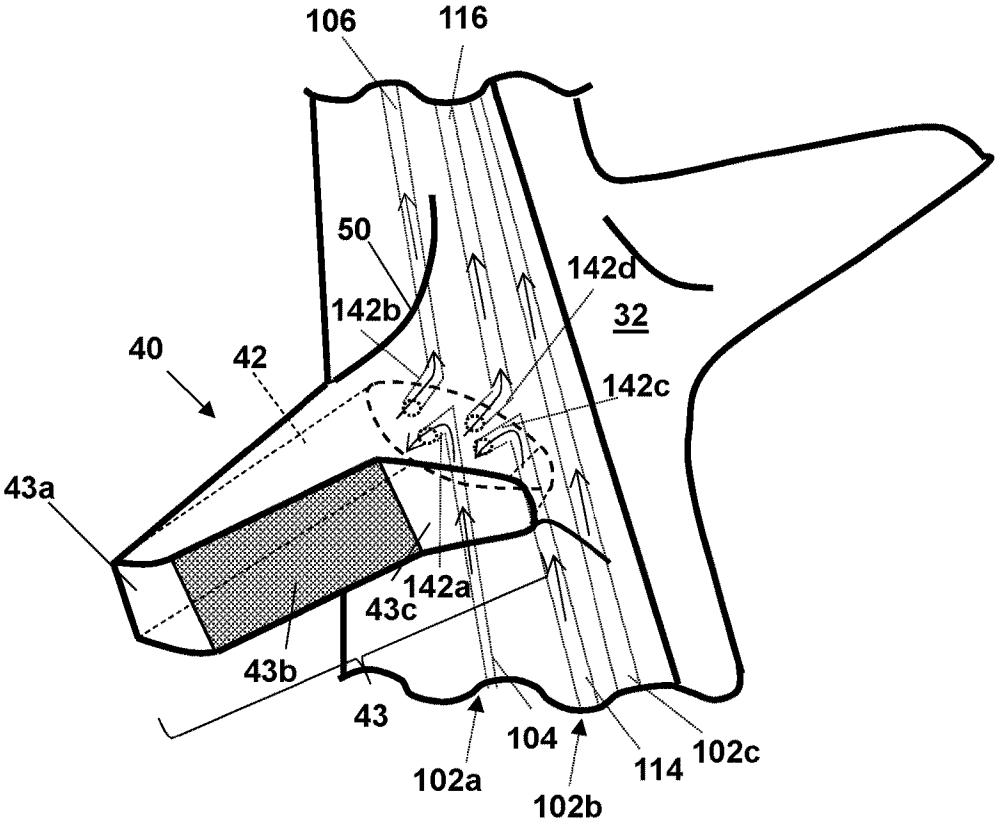

Further, in other embodiments, contact surface 43 may be covered but may not include openings 144 (FIGS. 20-22) to release the cooling fluid from hollow passages within part span shroud 40. Rather, in these embodiments, the cooling fluid can be returned to radial cooling passages 102 back through hollow passages 142. For example, referring now to FIG. 23, radial cooling passage 102*a* may be fluidly connected to hollow passage 142. In this embodiment, hollow passage 142 may be a serpentine hollow passage such that hollow passage 142 extends longitudinally within part span shroud 40 between fillet 50 and contact surface 43 and bends such that hollow passage 142 is redirected back away from contact surface 43 and toward fillet 50. As shown in FIG. 23, radial cooling passage 102*a* is fluidly connected to hollow passage 142. As cooling fluid travels (shown by arrows) through a first portion 104 of radial cooling passage 102*a* it is redirected through hollow passage 142 within part span shroud 40 such that the cooling fluid travels toward contact surface 43 from fillet 50. As the cooling fluid approaches contact surface 43, via hollow passage 142, it is redirected away from contact surface 43 back toward fillet 50 and back into a second portion 106 of radial cooling passage 102*a* within airfoil 32. As shown, first portion 104 and second portion 106 are not directly connected. Rather, they are connected via hollow passage 142. It is to be understood that the same could apply to radial cooling passages 102*b*, 102*c*, or any additional radial cooling passages within airfoil 32, but has not been shown herein for brevity.

The serpentine configuration of hollow passage 142 according to this embodiment may be formed via additive manufacturing. Additive manufacturing (AM) includes a wide variety of processes of producing an object through the successive layering of material rather than the removal of material. As such, additive manufacturing can create complex geometries without the use of any sort of tools, molds or fixtures, and with little or no waste material. Instead of machining objects from solid billets of material, much of which is cut away and discarded, the only material used in additive manufacturing is what is required to shape the object.

Additive manufacturing techniques typically include taking a three-dimensional computer aided design (CAD) file of the object to be formed that includes an intended three-dimensional (3D) model or rendering of the object. The intended 3D model can be created in a CAD system, or the intended 3D model can be formulated from imaging (e.g., computed tomography (CT) scanning) of a prototype of an object to be used to make a copy of the object or used to make an ancillary object (e.g., mouth guard from teeth molding) by additive manufacturing. In any event, the intended 3D model is electronically sliced into layers, creating a file with a two-dimensional image of each layer. The file may then be loaded into a preparation software system that interprets the file such that the object can be built by different types of additive manufacturing systems. In 3D printing, rapid prototyping (RP), and direct digital manufacturing (DDM) forms of additive manufacturing, material layers are selectively dispensed to create the object.

In metal powder additive manufacturing techniques, such as selective laser melting (SLM) and direct metal laser melting (DMLM), metal powder layers are sequentially melted together to form the object. More specifically, fine metal powder layers are sequentially melted after being uniformly distributed using an applicator on a metal powder bed. The metal powder bed can be moved in a vertical axis. The process takes place in a processing chamber having a precisely controlled atmosphere of inert gas, e.g., argon or nitrogen. Once each layer is created, each two dimensional slice of the object geometry can be fused by selectively melting the metal powder. The melting may be performed by a high powered laser such as a 100 Watt ytterbium laser to fully weld (melt) the metal powder to form a solid metal. The laser moves in the X-Y direction using scanning mirrors, and has an intensity sufficient to fully weld (melt) the metal powder to form a solid metal. The metal powder bed is lowered for each subsequent two dimensional layer, and the process repeats until the three-dimensional object is completely formed.

In many additive manufacturing techniques the layers are created following the instructions provided in the intended 3D model and using material either in a molten form or in a form that is caused to melt to create a melt pool. Each layer eventually cools to form a solid object.

In yet another embodiment, radial cooling passage 102*a* may include a first portion 104 and a second portion 106 and radial cooling passage 102*b* may include a first portion 114 and a second portion 116. In this embodiment, first portion 104, 114 is fluidly connected to hollow portion 42 via hollow passages 142*a*, 142*c*, respectively. Additionally, second portions 106, 116 are fluidly connected to hollow portion 42 via hollow passages 142*b*, 142*d*. In this embodiment, cooling fluid (shown by arrows) may travel through first portions 104, 106 of radial cooling passages 102*a*, 102*b* to hollow passages 142*a*, 142*c* into hollow portion 42. The cooling fluid may travel from hollow portion 42 through hollow passages 142*b*, 142*d* to second portions 106, 116. It is to be understood that he same could apply to radial cooling passage 102*c*, or any additional radial cooling passages within airfoil 32, but has not been shown herein for brevity.

To form the configuration according to this embodiment, first portions 104, 114 of radial cooling passages 102*a*, 102*b* may be formed by drilling from the bottom of airfoil 32. Second portions 106, 116 of radial cooling passages 102*a*, 102*b* may be formed by drilling from the top of airfoil 32 without making connection to first portions 104, 114. Subsequently, hollow passages 142*a-d* may be drilled through fillet 50 connecting to first portions 104, 114 and second portions 106, 116. Further, hollow portion 42 may be formed in part span shroud 40 via EDM or other equivalent machine manufacturing process such that hollow portion is open to or fluidly connected to hollow passages 142*a-d*. Subsequently, contact surface 43 may be covered, for example, by brazing or welding.

It is to be understood that the descriptions of hollow portion 42 and hollow passages 142 described herein are equally applicable to both the suction 46 and pressure side 44 portions of part span shrouds of blade 20.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotating blade for a turbomachine, the rotating blade comprising:
- an airfoil portion;
- a root section affixed to a first end of the airfoil portion;
- a tip section affixed to a second end of the airfoil portion, the second end being opposite the first end; and
- a part span shroud affixed to the airfoil portion between the root section and the tip section, the part span shroud including:
  - a hollow portion devoid of any coupling structure; and
  - a contact surface having a first section, a second section, end a third section, the second section being disposed between the first section and the third section, and being brazed or welded to enclose a portion of the hollow portion.

2. The rotating blade of claim 1, wherein the hollow portion is disposed on an interior of a leading edge of the part span shroud.

3. The rotating blade of claim 1, wherein the part span shroud further comprises a fillet for easing an exterior corner formed by the part span shroud and the airfoil portion.

4. The rotating blade of claim 3, wherein a size and a shape of the fillet are optimized based on the part span shroud including the hollow portion.

5. The rotating blade of claim 1, wherein a center of gravity of the part span shroud is laterally aligned with a center of gravity of the blade.

6. The rotating blade of claim 5, wherein the part span shroud is disposed on the airfoil portion nearer to a leading edge than a trailing edge.

7. The rotating blade of claim 1, wherein the rotating blade operates as one of:
- a front stage blade in a compressor,
- a latter stage blade in a gas turbine, or
- a low pressure section blade in a steam turbine.

8. The rotating blade of claim 1, wherein the second section is brazed or welded with at least one of: colbalt-chromium-tungsten alloy or cobalt-chromium-molybdenum alloy.

9. The rotating blade of claim 1, wherein the first section and third section are brazed or welded with at least one of: a nickel based alloy or a nickel based super alloy.

10. A turbomachine comprising:
- a rotor rotatably mounted within a stator, the rotor including:
- a shaft; and
- at least one rotor wheel mounted on the shaft, each of the at least one rotor wheels including a plurality of radially outwardly extending blades mounted thereto,
- wherein each blade includes:
  - an airfoil portion;
  - a root section affixed to a first end of the airfoil portion;
  - a tip section affixed to a second end of the airfoil portion, the second end being opposite the first end; and
  - a part span shroud affixed to the airfoil portion between the root section and the tip section, the part span shroud including:
    - a hollow portion devoid of any coupling structure; and
    - a contact surface having a first section, a second section, and a third section, the second section being disposed between the first section and the third section, and being brazed or welded to enclose a portion of the hollow portion.

11. The turbomachine of claim 10, wherein the hollow portion is disposed on an interior of a leading edge of the part span shroud.

12. The turbomachine of claim 10, wherein the part span shroud further comprises a fillet for easing an exterior corner formed by the part span shroud and the airfoil portion.

13. The turbomachine of claim 12, wherein a size and a shape of the fillet are optimized based on the part span shroud including the hollow portion.

14. The turbomachine of claim 10, wherein a center of gravity of the part span shroud is laterally aligned with a center of gravity of the blade.

15. The turbomachine of claim 14, wherein the part span shroud is disposed on the airfoil portion nearer to a leading edge than a trailing edge.

16. The turbomachine of claim 10, wherein the turbomachine comprises one of: a gas turbine, a steam turbine, or a compressor.

17. The turbomachine of claim 10, wherein the second section is brazed or welded with at least one of: colbalt-chromium-tungsten alloy or cobalt-chromium-molybdenum alloy.

18. The turbomachine of claim 10, wherein the first section and third section are brazed or welded with at least one of: a nickel based alloy or a nickel based super alloy.

* * * * *